US011598568B2

(12) United States Patent
Larson et al.

(10) Patent No.: US 11,598,568 B2
(45) Date of Patent: Mar. 7, 2023

(54) SMART ICE MACHINE WITH SEPARATELY FABRICATED CUPS FOR THE ICE TRAY

(71) Applicant: ILLINOIS TOOL WORKS INC., Glenview, IL (US)

(72) Inventors: Eric K. Larson, Cumberland, RI (US); William D. Chatelle, Cranston, RI (US); Juan Barrena, Johnson, RI (US); Mark Edward Brewer, New Berlin, WI (US); Dharman B. Kothari, West Allis, WI (US); Jarod Sulik, Elkhorn, WI (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 56 days.

(21) Appl. No.: 16/068,400

(22) PCT Filed: Jan. 19, 2017

(86) PCT No.: PCT/US2017/014088
§ 371 (c)(1),
(2) Date: Jul. 6, 2018

(87) PCT Pub. No.: WO2017/132047
PCT Pub. Date: Aug. 3, 2017

(65) Prior Publication Data

US 2019/0011167 A1 Jan. 10, 2019

Related U.S. Application Data

(60) Provisional application No. 62/288,652, filed on Jan. 29, 2016.

(51) Int. Cl.
*F25C 1/246* (2018.01)
*F25C 5/08* (2006.01)

(52) U.S. Cl.
CPC ..... *F25C 1/246* (2013.01); *F25C 5/08* (2013.01); *F25C 2305/0221* (2021.08); *F25C 2700/00* (2013.01)

(58) Field of Classification Search
CPC ..... F25C 1/246; F25C 5/08; F25C 2700/00
See application file for complete search history.

(56) References Cited

U.S. PATENT DOCUMENTS 1,780,422 A * 11/1930 Geiler ..... F25C 1/24 249/122
2,415,451 A * 2/1947 Synnestvedt ..... F25C 1/24 62/135
2,469,057 A 5/1949 Follin
(Continued)

FOREIGN PATENT DOCUMENTS

CN 1766969 A 5/2006
CN 101384871 A 3/2009
EP 2660540 A2 11/2013

*Primary Examiner* — Lionel Nouketcha
(74) *Attorney, Agent, or Firm* — Boyle Fredrickson, S.C.

(57) ABSTRACT

An ice-tray for ice-making machines is formed by modular fabricated cups that can assembled together within a frame to create an ice-tray of arbitrary dimensions allowing a sharing of components among a variety of ice-tray sizes. Individual cups may include ice formation sensors or heaters or may be heated by an induction heating system.

22 Claims, 6 Drawing Sheets

(56) References Cited

U.S. PATENT DOCUMENTS

| | | | | |
|---|---|---|---|---|
| 2,469,067 | A * | 5/1949 | Follin | F25C 1/24 249/120 |
| 2,478,312 | A * | 8/1949 | Peltier | F25C 1/24 62/526 |
| 2,614,399 | A * | 10/1952 | Roethel | F25C 1/24 249/120 |
| 10,072,885 | B2 * | 9/2018 | Jeong | F25C 1/243 |
| 2005/0115266 | A1 * | 6/2005 | Lim | F25C 5/22 62/351 |
| 2006/0086134 | A1 | 4/2006 | Voglewede et al. | |
| 2007/0170345 | A1 * | 7/2007 | Tsujimoto | F25C 1/243 249/114.1 |
| 2009/0178430 | A1 * | 7/2009 | Jendrusch | F25C 1/24 62/345 |
| 2012/0023996 | A1 * | 2/2012 | Herrera | F25C 1/04 62/340 |
| 2012/0055188 | A1 * | 3/2012 | Levie | F25C 1/24 62/340 |
| 2013/0061626 | A1 * | 3/2013 | Son | F25C 5/22 62/344 |
| 2013/0152617 | A1 * | 6/2013 | Oh | F25C 5/08 62/351 |
| 2014/0230474 | A1 * | 8/2014 | Brown | F25C 1/22 62/177 |
| 2015/0241102 | A1 * | 8/2015 | Lee | F25D 23/126 62/71 |
| 2015/0276295 | A1 | 10/2015 | Barrena et al. | |

* cited by examiner

SMART ICE MACHINE WITH SEPARATELY FABRICATED CUPS FOR THE ICE TRAY

CROSS-REFERENCE TO RELATED APPLICATIONS

This application is a U.S. national phase entry of international application: PCT/US2017/014088, filed Jan. 19, 2017, which claims the benefit of US provisional application 62/288,652 filed Jan. 29, 2016 and hereby incorporated by reference.

FIELD OF THE INVENTION

The present invention relates to ice-making machines for home refrigerators and the like and specifically to ice-making trays for such machines using a modular design facilitating the production of different sizes of ice-making machines.

BACKGROUND OF THE INVENTION

Household refrigerators commonly include automatic ice-makers, for example, located in the freezer compartment. A typical ice-maker provides an ice cube tray positioned to receive water from an electrically controlled valve that may open for a predetermined time to fill the tray. The water is allowed to cool until ice formation is ensured. At this point, the ice is harvested from the tray into an ice bin positioned beneath the ice-tray. The amount of ice in the ice bin may be checked through the use of the bail arm which periodically lowers into the ice bin to check the ice level. If the bail is blocked in its descent by a high level of ice, this blockage is detected and ice production is stopped.

One method of harvesting ice cubes from the trays employs a tray heater. Typically, in this case, the ice-tray will be a metal die-cast part incorporating an electrical resistance heater which heats the ice-tray to above the melting point of water to release the ice when the tray is inverted by a motor. The electrical resistance heater and the ice-maker motor normally operate directly at a line voltage of about 120 volts AC eliminating the need for external power processing or sophisticated control electronics in the associated refrigerator.

Refrigerators are produced in a variety of sizes in order to provide a cost-effecting and energy efficient option that best fits the needs of different consumers. These different sizes of refrigerators may employ different ice-tray configurations, typically providing anywhere from 6 to 21 ice cubes per tray. The manufacture of different sizes of die cast metal ice-trays can incur substantial tooling costs, for example, in the production of different metal dies, when such a range of different sizes of ice cube trays is desired.

SUMMARY OF THE INVENTION

The present invention provides a modular ice-tray that employs as few as two different ice cube mold modules that can be assembled into ice-trays for molding as few as four cubes to an arbitrarily large number of cubes depending on the number of mold modules employed. The mold modules may be efficiently manufactured in large numbers, for example, by molding or drawing operations and then used for many different tray implementations.

Specifically, the present invention provides an ice-tray for use in an ice-making machine constructed of a set of separately fabricated cups each open at a rim for receiving water into at least one cup volume defining a shape of an ice cube that may be frozen within the fabricated cup and a frame adapted to receive and retain the set of fabricated cups to produce an ice-tray in which the cups open in a common direction from a first side of the frame to receive water from an ice-making machine supporting the frame therein.

It is thus a feature of at least one embodiment of the invention to provide an ice-tray that can be efficiently manufactured in a variety of different sizes with reduced tooling costs.

The set of separately fabricated cups may provide laterally extending channels at the rims of the cups permitting intercommunication of the cup volumes of the separately fabricated cups when assembled together in the frame.

It is thus a feature of at least one embodiment of the invention to provide a self equalizing water flow among the modular fabricated cups necessary for common ice-making machines introducing water at a single location in the tray.

The laterally extending channels may extend in at least two perpendicular directions from each cup volume.

It is thus a feature of at least one embodiment of the invention to provide a modular system that will naturally tile to provide interconnection between the volume of each cup and the volumes of adjacent cups.

The set of cups may include two cup types, a first cup type providing only two laterally extending channels from each cup volume, and a second cup type providing three laterally extending channels extending from each cup volume; whereby two cup types can be assembled into an ice-tray having two rows and an arbitrary number of columns of fabricated cups.

It is thus a feature of at least one embodiment of the invention to provide as few as two types of cups that can be manufactured to produce a wide range of sizes of ice-trays.

The fabricated cups may include a radial flange at the rim abutting a corresponding planar wall on the first side of the frame aligning the cups along the planar wall.

It is thus a feature of at least one embodiment of the invention to provide a simple mechanism of aligning the cups in a common plane for improved water flow equalization between the cups.

The fabricated cups may each provide two cup volumes each defining the shape of one of two different corresponding ice cubes that may be frozen within the fabricated cup It is thus a feature of at least one embodiment of the invention to minimize the number of components necessary to manufacture common ice-tray types.

The frame may be an injection molded thermoplastic material.

It is thus a feature of at least one embodiment of the invention to provide a relatively low-cost integrating structure that can be used to assemble prefabricated cups together in a variety of different tray sizes. Tooling needed for an injection molded frame can be substantially less than that required for a drawing operation for fabrication of different sizes of trays of metal.

The frame may mechanically capture the separately fabricated cups between thermoplastic elements formed around the fabricated cups.

It is thus a feature of at least one embodiment of the invention to provide a simple method of integrating the dissimilar materials of the cups and frame together into an integrated ice-tray. It is another object of the invention to provide an improved ice-tray that may reduce the thermal mass of the ice cups through reduced thickness drawn metal supported by a robust thermoplastic tray to provide quicker freezing and heat release of the formed cubes.

The ice-tray may further include a sensor communicating with at least one fabricated cup for detecting the state of water within the fabricated cup as being frozen or unfrozen.

It is thus a feature of at least one embodiment of the invention to provide a modular ice-tray that can cycle faster by detecting ice formation.

The sensor may be an electrode pair communicating with a circuit sensing a change in electrical properties between the electrode pair caused by a freezing of water.

It is thus a feature of at least one embodiment of the invention to provide a method of directly sensing ice formation eliminating the need to infer ice formation from temperature and time such as may be inaccurate.

The fabricated cup may provide two electrically isolated halves forming the sensor pair.

It is thus a feature of at least one embodiment of the invention to use the cup itself as the sensing electrodes to provide greater sensing area and thus more robust sensing.

The circuit may analyze at least one of a value of resistance and capacitance between the sensor electrodes to compare that value against a threshold indicating frozen water and unfrozen water.

It is thus a feature of at least one embodiment the invention to provide a flexible method of detecting ice formation.

The circuit may further analyze the value to detect an empty tray.

It is thus a feature of at least one embodiment of the invention to provide a sensor system that can also detect whether an ice-molding volume is empty of ice or water.

The ice tray may further include a heater communicating with the fabricated cups for heating the fabricated cups to release the ice cubes formed in the fabricated cups.

It is thus a feature of at least one embodiment of the invention to provide a method of releasing the ice cubes from the composite tray thus formed eliminating the need to warp the tray as an alternative method of releasing ice cubes.

The heater may be an induction heater communicating with the fabricated cups through a magnetic field inducing eddy currents in the metal of the fabricated cups.

It is thus a feature of at least one embodiment of the invention to provide a simple mechanism of heating multiple cups assembled together in a frame without the need for complex circuitry and interconnection.

Other features and advantages of the invention will become apparent to those skilled in the art upon review of the following detailed description, claims and drawings in which like numerals are used to designate like features.

Figure 1:
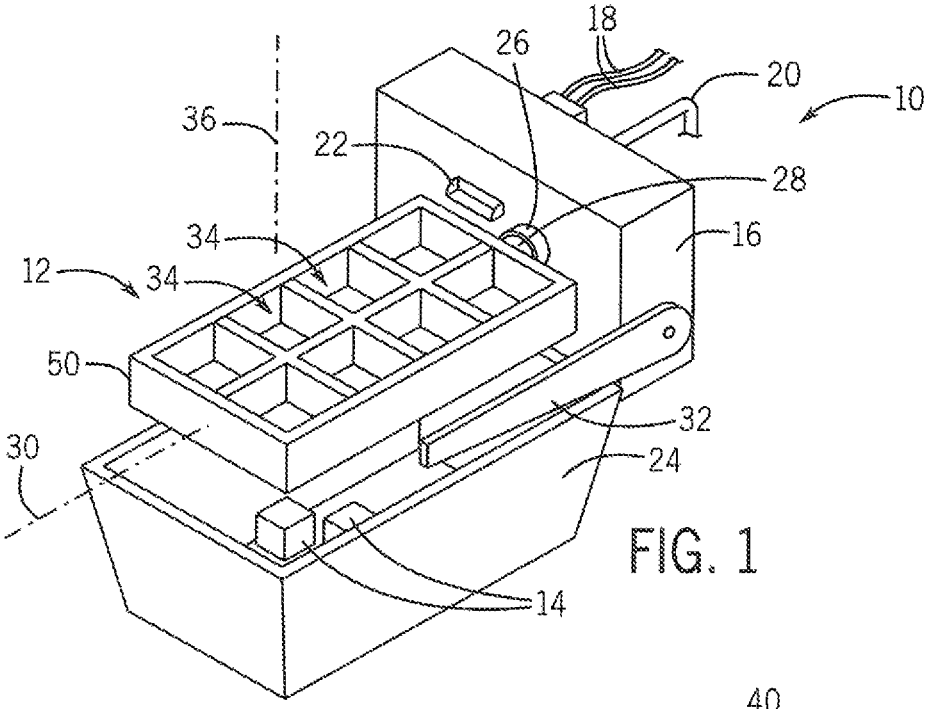
FIG. 1 is a perspective view of an ice-making machine incorporating the ice-tray of the present invention such as can he rotated above an ice bin for discharge of ice cubes into the bin.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as addition, items and equivalents thereof.

DETAILED DESCRIPTION OF THE PREFERRED EMBODIMENTS

Referring now to FIG. 1, an ice-maker 10 may include an ice-tray 12 for receiving water and molding it into frozen ice cubes 14 of arbitrary shape. The ice-tray 12 may be positioned adjacent to ice harvest drive 16 communicating with electrical power and control signals from a refrigerator (not show-in) through power conductors 13 and with a water supply through water line 20.

The ice harvest drive 16 may fill the ice-tray 12, for example, through a fill nozzle 22 and after the water is frozen, eject cubes 14 from the ice-tray 12, for example, by inversion of the ice-tray 12 and heating of the ice-tray 12 until the ice cubes 14 fall from the ice-tray 12. The ice-tray 12 may be positioned above an ice storage bin 24 for receiving cubes 14 therein when the latter are ejected from the ice-tray 12.

The ice harvest drive 16 may provide a drive coupling 26 exposed at a front wall of a housing of the ice harvest drive 16 and communicating with the corresponding coupling 28 on the ice-tray 12. The drive coupling 26 may rotate about an axis 30 along which the ice-tray 12 extends thereby rotating the ice-tray 12 as is necessary for filling the ice-tray 12 with water and ejecting the ice cubes 14 from the ice-tray 12.

The ice harvest drive 16 may have a bail arm 32 that pivots about a horizontal axis generally perpendicular to axis 30 to periodically swing down into the ice storage bin 24 to contact an upper surface of the pile of cubes 14 in the ice storage bin 24. In this way the bail arm 32 may determine the height of those cubes 14 and deactivate the ice-maker 10 when a sufficient volume of cubes 14 is in the ice storage bin 24 to prevent full descent of the bail arm 32.

Figure 2:
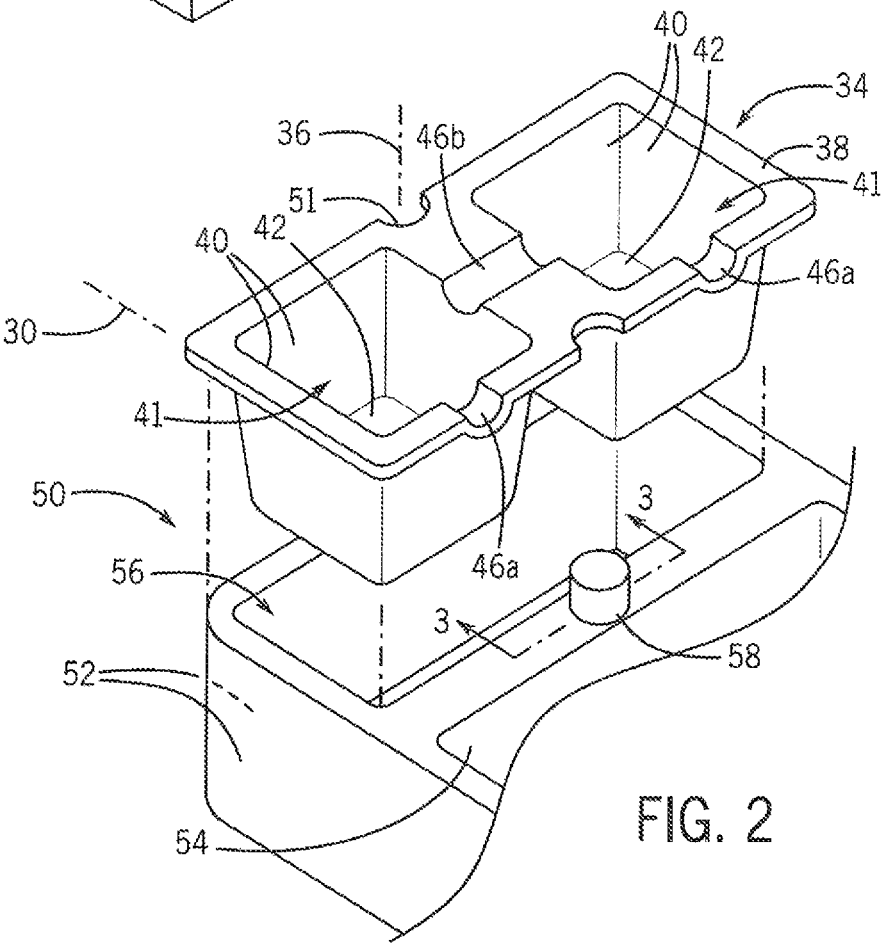
FIG. 2 is a perspective fragmentary view of the ice-tray of FIG. 1 showing its construction from modular ice-mold cups fitting within a frame.

Referring also to FIG. 2, the ice-tray 12 may be constructed from a set of separate ice-mold cups 34 each open upwardly from the ice-tray 12 generally parallel to axis 36, perpendicular to axis 30 and normal to an upper face of the ice-tray 12. The upper edge of the ice-mold cups 34 is defined by a rim 38 extending laterally outward, generally in a plane perpendicular to axis 36. The rim 38 passes continuously around a periphery of the upper open end of the cups 34.

Sidewalls 40 of the cup 34 extend downwardly from an inner periphery of the rim 38 to a bottom wall 42 parallel to and displaced downward from the rim 38. The sidewalls 40 and bottom wall 42 together define a cup volume 41 determining the shape of one or more ice cubes that can be molded in the ice-mold cups 34. Although a rectangular prismatic volume 41 is shown, other shapes such as cylinders, cones, hemispheres, hemi-cylinders and the like are also contemplated by the present invention. Generally each of these volumes 41 will be arranged to provide for an inward sloping of the sidewalls 40 as one moves toward the bottom wall 42 to provide proper draft for removal of the ice cubes 14 without interference by undercuts or the like.

Hemi-cylindrical channel 46*a*, extending along axis 30, or hemi-cylindrical channel 46*b* extending perpendicular to axis 30, each lying within a plane of the upper face of the ice-tray 12, are formed in the upper edge of some of the sidewalls 40 so that water filling any one of the volumes 41 will equalize among the volumes 41 by means of water passing through the channels 46 between volumes 41 as the water approaches a fill level above those channels 46. Generally, each volume 41 of an assembled ice-tray 12 will communicate either directly or indirectly through the channels 46 with every other volume 41 in the ice-tray 12 when the ice-tray 12 is in the uptight horizontal position during filling.

Multiple ice-mold cups 34 may be tiled together in a frame 50 providing upwardly extending peripheral walls 52 and internal stiffening divider walls 54 of equal height, these walls together providing a set of pockets 56 for receiving the volumes 41 of the ice-mold cups 34 therein with a bottom surface of the rim 38 resting against the corresponding upper surface of the walls 52 and 54.

As so positioned in the frame 50, the multiple ice cups 34 will face upward and will be aligned with the rims 38 and a common plane. In one embodiment, the frame may be generally rectangular to organize the ice-mold cups 34 in two rows extending parallel to axis 30 and an arbitrary but predefined number of columns perpendicular thereto.

Figure 3:
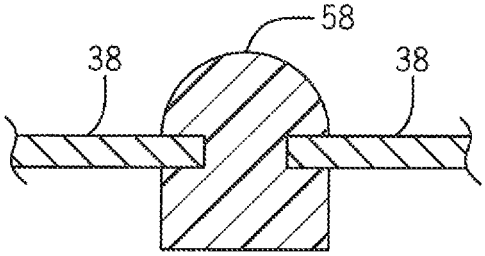
FIG. 3 is a cross-sectional view along line 3-3 of FIG. 2 showing a staking operation for integrating the ice-mold cups into the frame.

The rim 38 may include cutouts 51 that pass around corresponding bosses 58, for example, extending upwardly from the upper surface of the divider walls 54 which support the rims when the ice-mold cups 34 are in place within the frame 50. As shown in FIG. 3, the boss 58 may then be staked downward over the rims 38 of the installed cups 34 to retain them in the frame 50. In one embodiment, the frame 50 may be constructed of a thermoplastic material and the staking process may be accomplished by ultrasonic or thermal staking or the like which peens down the upper end of the boss 58 over the surface of the rim 38.

Figure 4:
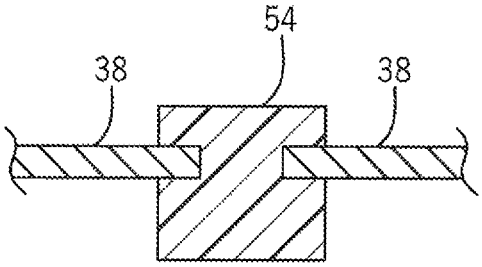
FIG. 4 is a figure similar to that of FIG. 3 showing an in-molding approach incorporating the ice-mold cups into the frame.

Referring alternatively to FIG. 4, the boss 58 may be eliminated and the cups 34 may be insert molded into the thermoplastic material of the walls 52 of the frame 50. As is understood in the art, insert molding incorporates the mold cups 34 into a thermoplastic mold to be partially surrounded by molten thermoplastic during the molding process. In both cases, an integrated structure is thereby produced.

Alternatively, the cups 34 may be press fit into the frame 50 and for this purpose not have the flange or rim 38.

Figure 5:
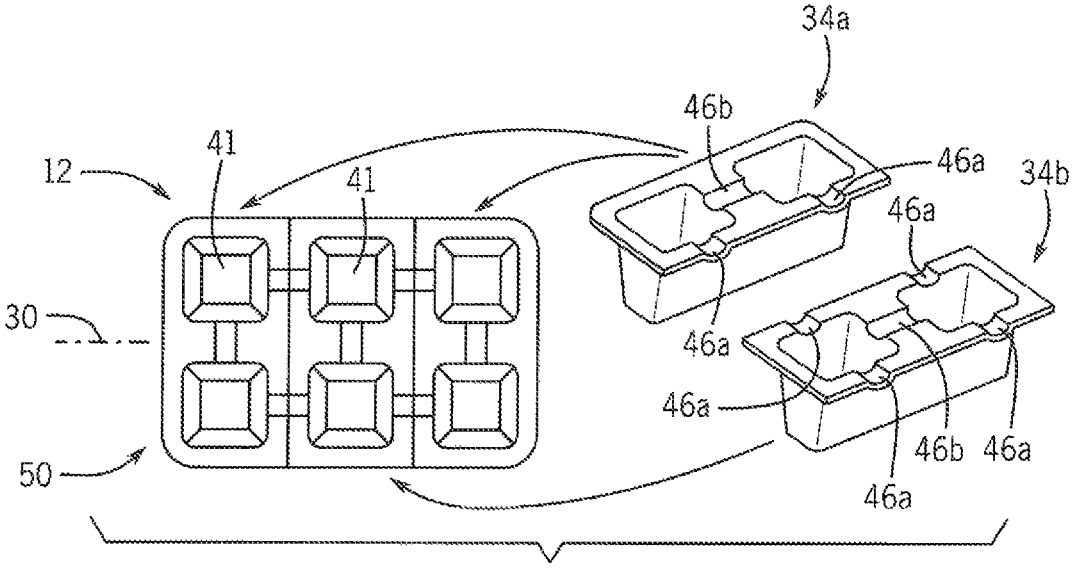
FIG. 5 is a top plan view of a first ice-tray assembled from two different types of ice-mold cups each providing dual ice-molding volumes and showing perspective views of those two different types of ice-mold cups illustrating their different channel configurations.
Figure 6:
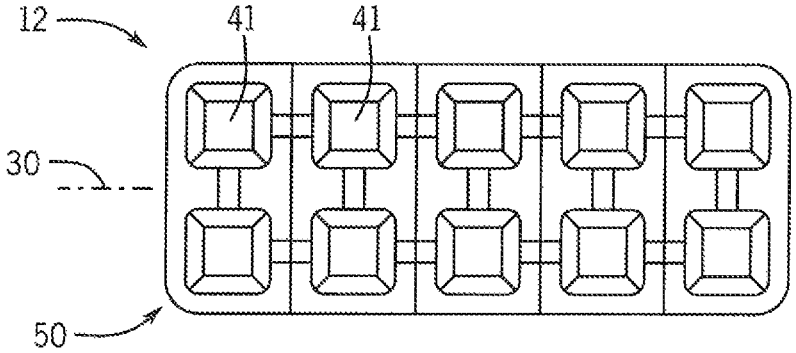
FIG. 6 is a figure similar to FIG. 5 showing a second ice-tray having different dimensions assembled from the two different types of ice-mold cups of FIG. 5.

Referring now to FIGS. 5 and 6, with the production of only two different types of cups 34*a* and 34*b*, a variety of different ice-trays 12 may be produced. In one embodiment, the first type of cup 34*a* provides an end cup that may fill ends of the frame 50 opposed along axis 30 with one of the cups 34*a* rotated 180 degrees with respect to the other cup 34*a*. The second type of cup 34*b* may then be placed between the end cups provided by the first type of cup 34*a* to fill in between these cups 34*a*. In FIG. 5, one cup 34*b* may be used with two end cups 34*a* to create a six-volume ice-tray 12. In FIG. 6, three cups 34*b* may be used between two end cups 34*a* to create a 10-volume ice-tray 12.

Referring again to FIG. 5, end cups 34*a* differ from cups 34*b* by the locations of the channels 46*a* and 46*b*. Specifically, cup 34*a* provides only two perpendicular channels 46*a* extending from each cup volume 41 while cup 34*b* provides three channels 46 (two channels 46*a* mutually parallel and one perpendicular channel 46*b*) extending from each cup volume 41. In this way all cup volumes 41 of the assembled ice-tray 12 may intercommunicate with each of its neighbors through a channel 46.

Figure 7:
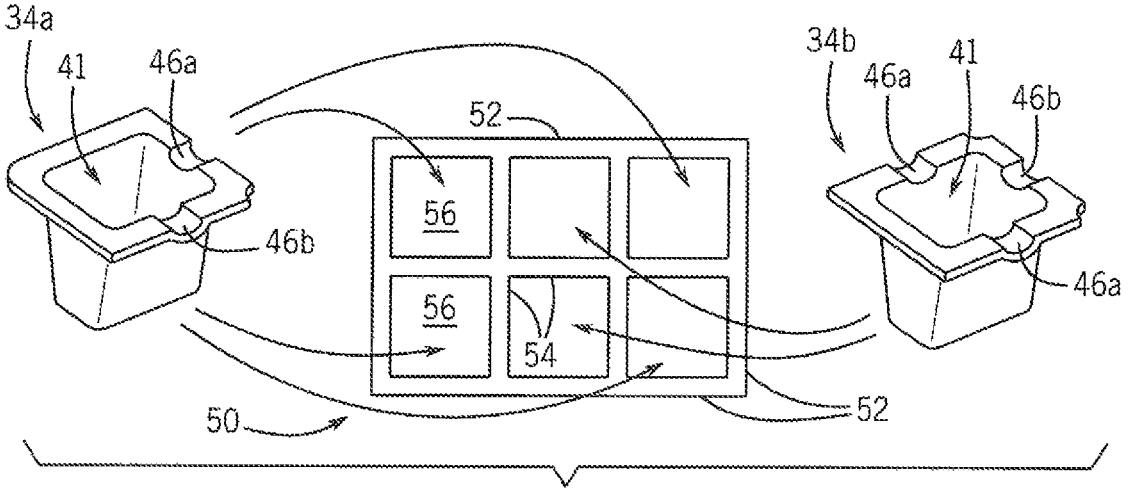
FIG. 7 is a figure similar to that of FIG. 5 showing an alternative embodiment where each ice-mold cup provides only a single ice-molding volume and showing a frame before assembly of the ice-mold and cups into the frame.

Referring now to FIG. 7, it will be appreciated that the system of the present invention may also be used with cups 34*a* and 34*b* each having only a single volume 41. In this case, the frame 50 may include mutually perpendicular divider walls 54 together providing pockets 56 sized to receive one volume 41 of one of the cups 34. Two cups 34*a* having a relative rotation of 90 degrees with respect to each other can fill a first end column of the frame 50. A duplicate assembly of two cups 34*a* may then be rotated by 180 degrees to fill the last column of the frame 50. Two cups 34*b* rotated relatively by 180 degrees may then fill the center columns of the frame 50. As before, cup 34*a* provides only two perpendicular channels 46*a* extending from each cup volume 41 while cup 34*b* provides three channels 46 (two parallel channels 46*a* and one perpendicular channel 46*b*) extending from each cup volume 41. In this way all cup volumes 41 of the assembled ice-tray 12 may intercommunicate with each of its neighbors through a channel 46.

Figure 8:
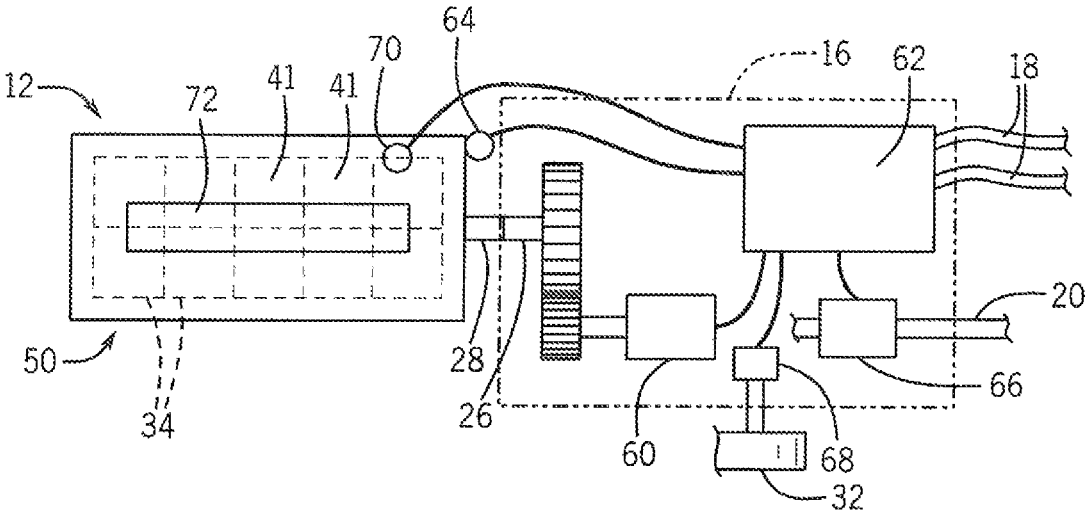
FIG. 8 is a block diagram of the electrical components of the ice-maker of FIG. 1 showing a heater for releasing ice cubes from the ice-tray and a sensor for sensing the state of water in the molding volumes.

Referring now to FIGS. 8 and 1, when the cups 34 and frame 50 are assembled into an ice-tray 12, the ice-tray 12 may connect with the ice harvest drive 16 through an inter-engagement of couplings 28 and 26 described above with respect to FIG. 1. Coupling 26 may be driven by an internal motor drive 60 controlled by a control circuit 62 that may rotate the ice-tray 12 about the axis 30 as desired for the making of ice under the control of signals generated by the control circuit 62 and/or from the refrigerator. An example of motor drive 60 and of other elements and components suitable for use in the ice harvest drive 16 are described in US patent application 2012/0186288 hereby incorporated in its entirety by reference.

The control circuit 62 may also communicate with a limit switch 64 providing an indication of the rotational position of the ice-tray 12 (e.g., upright or inverted) and the motor drive 60 operated according to knowledge of this position and a desired state of the ice-maker 10. Control circuit 62 may also control an electrically actuated valve 66 receiving water line 20 to controllably provide water to the ice-tray 12 when the ice-tray 12 is in the upright position. The control circuit 62 may further communicate with a limit switch 68 monitoring the position of the bail arm 32 to stop the production of ice when no additional ice is needed in the bin 24 (shown in FIG. 1). Further, the control circuit 62 may receive signals from an ice formation sensor 70 detecting whether ice is formed in a given volume 41 of the ice-tray 12 and send signals to an ice release heater 72 that may heat the ice cups 34 to release ice from those cups prior to ejecting the ice by inverting the ice-tray 12.

Figure 9:
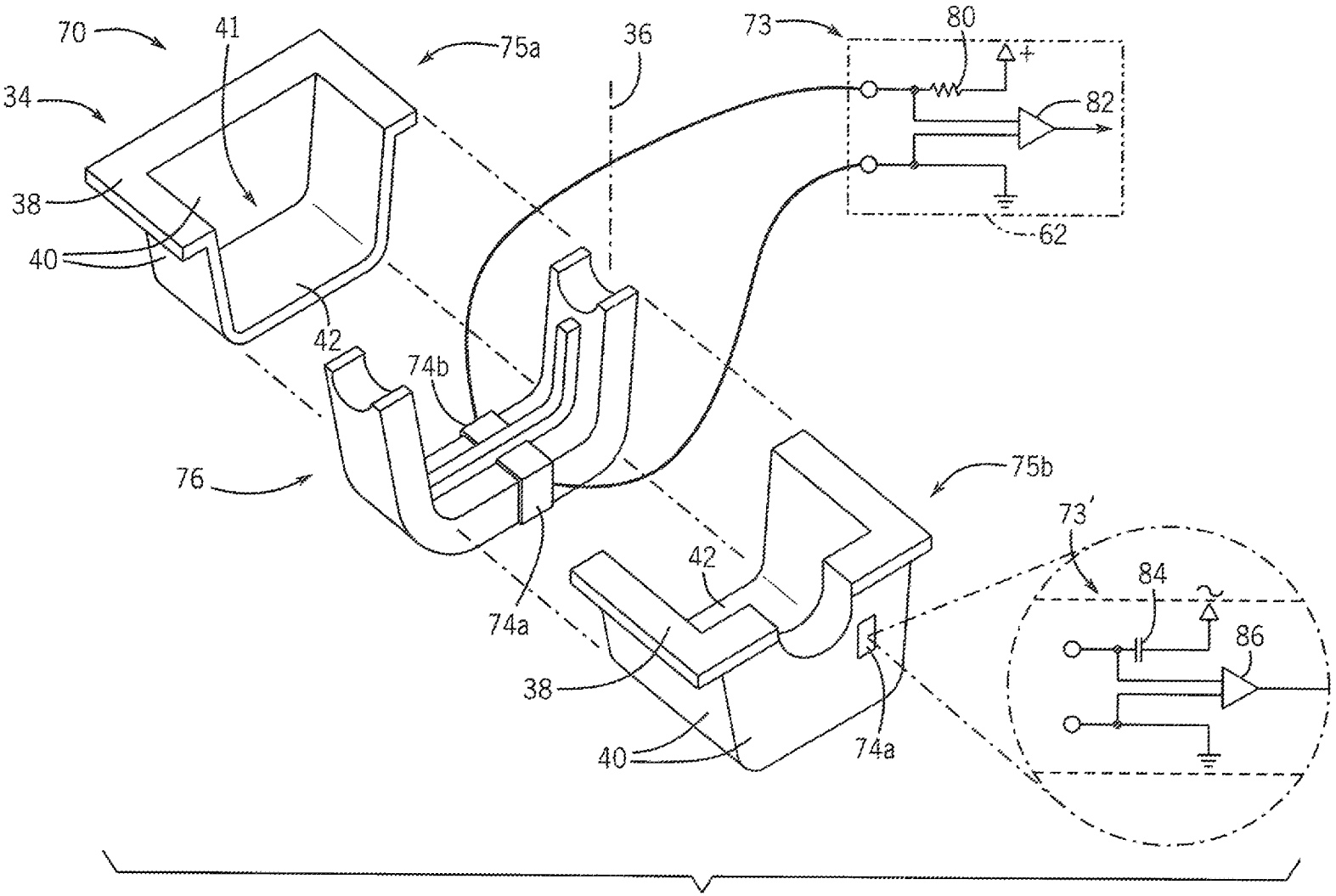
FIG. 9 is an exploded perspective view of an ice-molding; cup providing for ice state sensing using a resistive ice-sensing circuit communicating between electrically isolated halves of the ice-molding cup and showing, in an insert, an alternative capacitive ice-sensing circuit using the same ice-molding cup configuration.

Referring now to FIG. 9, the ice sensor 70 may operate in conjunction with an ice-sensing circuit 73, for example, integrated into the control circuit 62. The ice-sensing circuit may electrically connect with two sensing electrodes 74*a* and 74*b* communicating with the volume 41 within at least one of the ice cups 34 so that the sensing electrodes 74*a* and 74*b* are electrically isolated from each other but for electrical flow through liquid or solid water within the volume 41. In one embodiment, the electrodes 74*a* and 74*b* may make use of the walls of the ice cup 34 themselves as electrically conductive surfaces. In this regard, end ice cup 34 may be bisected into separate portions 75*a* and 75*b* along a plane parallel to axis 36 and an insulating divider 76 inserted therebetween to rejoin the bisected portions 75*a* and 75*b* into a watertight volume 41 operating in the same manner as an un-bisected cup 34 but for the electrical isolation between the portions 75*a* and 75*b*. Insulating divider 76 may, for example, be insert molded to engage with the portions 75*a* and 75*b* or attached by adhesive or other assembly techniques. The ice-sensing circuit 73 may be attached to sensor electrodes 74*a* and 74*b* supported by the insulating divider 76 to communicate with the separate portions 75*a* and 75*b*, respectively, or may be attached directly to, for example, outer surfaces of the portions 75*a* and 75*b*.

In one embodiment, the ice-sensing circuit 73 provides a DC voltage across the electrodes 74*a* and 74*b* through a current limiting resistor 80. High conductivity liquid water within the volume 41 provides a low resistance between the electrodes 74*a* and 74*b* reducing the voltage across the electrodes 74*a* and 74*b* such as may be sensed by threshold detection amplifier 82. Alternatively the ice-sensing circuit 73 (designated 73' in the inset of FIG. 9) may provide an AC voltage across electrodes 74*a* and 74*b* through a current limiting capacitor 84. In this case, high dielectric constant liquid water within the volume 41 provides a high capacitance between the electrodes 74*a* and 74*b* reducing the voltage across electrodes 74*a* and 74*b* (in this case AC amplitude) which again may be sensed by a threshold detection amplifier 86 providing a rectifying action. This latter approach permits the metal of the ice cup 34 to be anodized or otherwise coated with an electrical insulator which acts simply as an additional capacitance.

Figure 10:
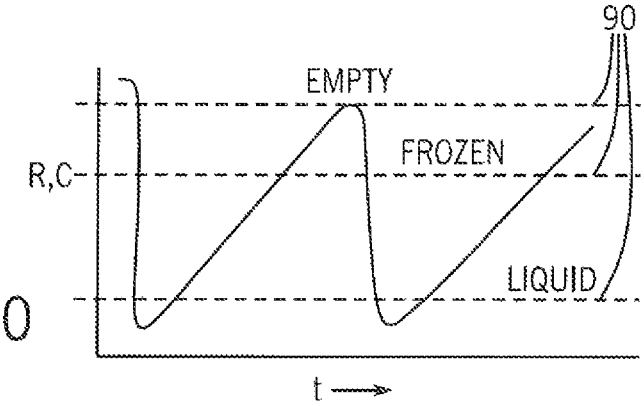
FIG. 10 is a plot of resistance and capacitance over time showing a signal produced by the resistive ice-sensing circuit and capacitive ice-sensing circuit of FIG. 9 over time as ice is formed in and ejected from molding volumes.

Referring now to FIG. 10, the signal produced by amplifiers 82 or 86 may be compared against several thresholds 90, for example, indicating whether the volume 41 is empty, contains ice, or contains liquid water. The results of this comparison, indicating the state of the volume 41, may be in turn compared against a schedule of known operation of the ice harvest drive 16 to help distinguish between ambiguous states and to allow the application of heat and harvesting of ice more precisely to provide improved energy efficiency.

Figure 11:
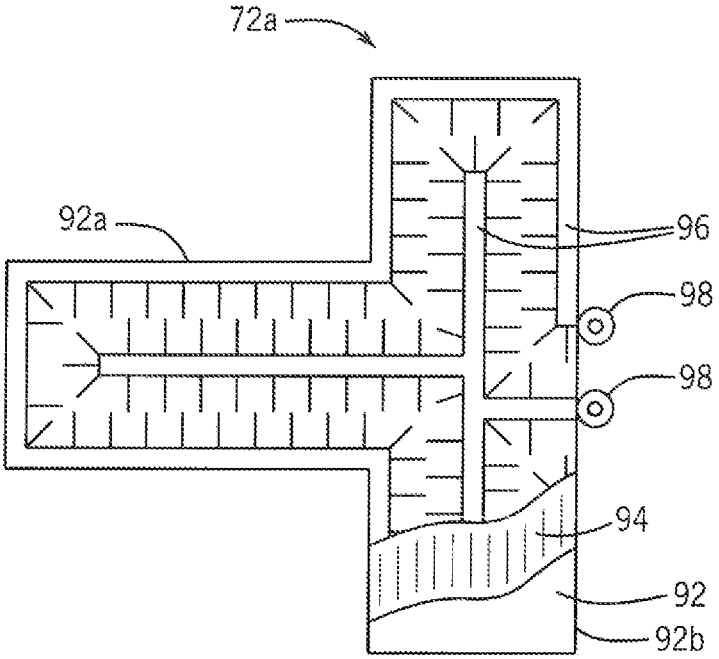
FIG. 11 is a top plan view of a flexible heater element that can be formed around an ice-mold cup to heat that cup for release of ice.
Figure 12:
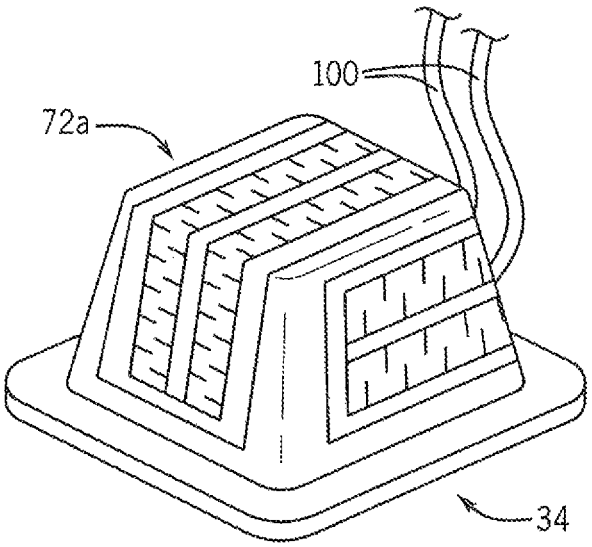
FIG. 12 is a perspective view of the underside of an ice-mold cup having the heater of FIG. 11 adhered to and installed thereabouts.

Referring now to FIGS. 11 and 12, in one embodiment, the heater 72 shown in FIG. 8 may be a flexible thick film heater 72*a* formed, for example, using a T-shaped flexible polymer sheet 92 having a coating of a positive temperature coefficient resistance material 94. The positive temperature coefficient, material 94 provides a resistance that varies according to the temperature of the material 94, permitting increased electrical flow at lower temperatures and decreased electrical flow at higher temperatures following a substantially nonlinear pattern as a function of temperature. This property provides for a self-regulating temperature of the heater 72*a* which may be set close to the melting point of ice for high efficiency heating of the cups 32 without overheating. Positive temperature coefficient (PTC) materials suitable for the present invention, are also disclosed in U.S. Pat. Nos. 4,857,711 and 4,931,627 to Leslie M. Watts hereby incorporated in their entirety by reference.

Applied over the top of the positive temperature coefficient resistance material 94 is an electrode array 96 providing interdigitated electrode fingers promoting current flow through the positive temperature coefficient resistance material 94 over a broad area of the heater 72*a*. This electrode array 96 may terminate in eyelets 98 providing attachment points for other electrical wiring 100 allowing multiple beater units be connected in parallel or in series. As noted, the heater 72*a* may connect via electrical wiring to the control circuit 62 shown in FIG. 8.

As shown in FIG. 12, the T-shaped flexible polymer sheet 92 may provide for a riser portion 92*a* and a crossbar portion 92*b* sized to allow the T-shape to be wrapped about and adhered to the outer surface of the cup 34, with the crossbar portions 92*b* covering the outside three adjacent panels of the sidewalk 40 and the riser portion 92*a* covering a bottom wall 42 and the remaining side wall 40 to conduct heat thereto. By placing temperature controlled heating in close proximity to each of the surfaces of the cups 32 only a thin film of water needs to be generated to release the ice cubes, greatly reducing energy usage.

Figure 13:
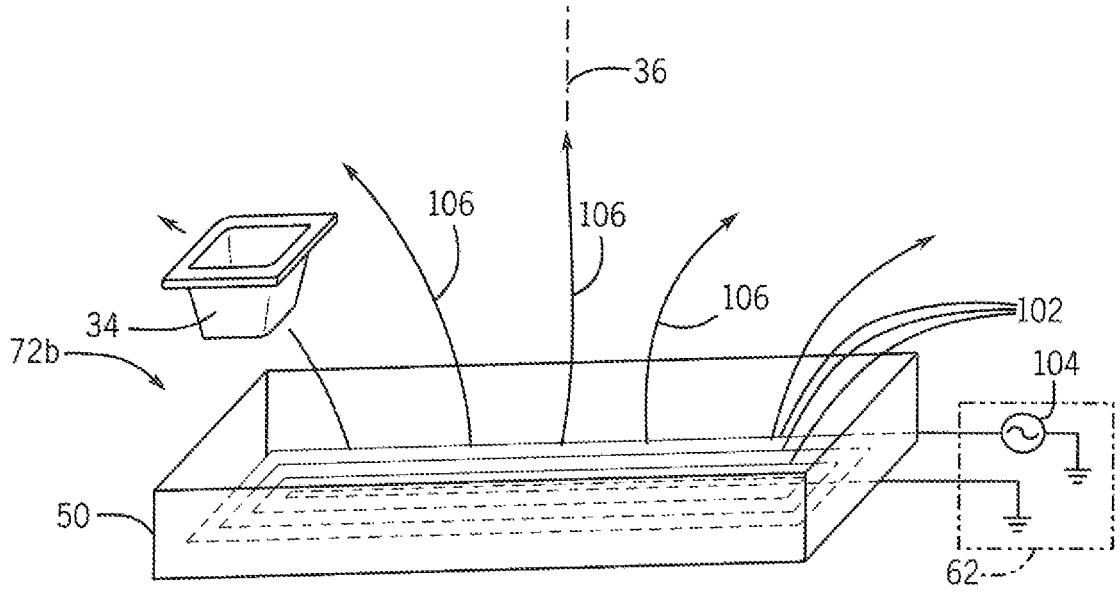
FIG. 13 is a simplified perspective view of the frame and one ice-mold cup of the present invention using an inductive heater for heating the ice-mold cups without mechanical contact thereto.

Referring now to FIG. 13, in an alternative embodiment the frame 50 may incorporate an induction coil 102 passing along the outer walk 52 of the frame 50 about axis 36. This induction coil 102 may be driven at a high frequency by a AC power source 104, for example, incorporated into control circuit 62 to create an oscillating magnetic field 106 passing upward (and downward) through multiple cups 32 contained in the frame 50.

Figure 14:
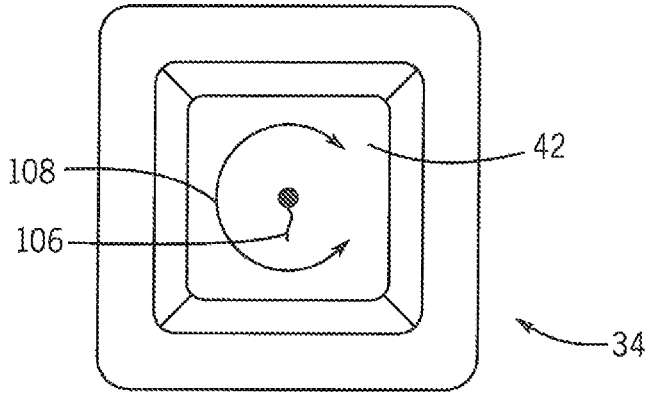
FIG. 14 is a top plan view of one ice-mold cup showing the induced eddy currents providing heating of the metallic material of the cup.

Referring now to FIG. 14, this varying magnetic field 106 creates an eddy current 108, for example, circulating in two directions in the bottom wall 42 creating heat through resistive loss that heats the bottom wall 42 and by conductive connection the sidewalk 40. Together, the induction coil 102, the power source 104 and the walls of the ice cup 34 form a heater 72*b*.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What is claimed is:

1. An ice-tray for use in an ice-making machine, the ice-tray comprising:

a modular cup arrangement providing multiple sets of cups, including:

a first set of end cups and a second set of end cups respectively provided at first and second ends of the modular cup arrangement toward first and second ends of the ice-tray;

at least one set of intermediate cups arranged between the first and second sets of end cups;

wherein:

adjacent ones of the first and second sets of end cups and the at least one set of intermediate cups define abutment joints;

each of the first and second sets of end cups and the at least one set of intermediate cups includes:

a set of metal cups each having a rim that defines an opening of the respective metal cup for receiving water into at least one cup volume bounded by interconnected cup sidewalls extending downwardly from the rim and a cup bottom wall displaced downwardly from the rim with the cup sidewalls and cup bottom wall collectively defining a shape of an ice cube that may be frozen within the at least one cup volume; and a thermoplastic frame in which the modular cup arrangement is fixedly mounted by capturing the outer periphery of the modular cup arrangement to produce an integrated ice-tray of dissimilar materials; wherein:

the thermoplastic frame includes a retainer that engages the abutment joints between the respective adjacent ones of the first and second sets of end cups and the at least one set of intermediate cups to fix the modular cup arrangement and the thermoplastic frame to each other providing an integrated structure of the ice-tray in which the openings of the metal cups face a common direction to receive water from the ice-making machine supporting the ice tray therein; and water passages are defined at the abutment joints to equalize a volume of water received from the ice-making machine into equalized volumes of water in the metal cups of the first and second sets of end cups and the at least one set of intermediate cups.

2. The ice-tray of claim 1 wherein:

each rim provides an outwardly extending rim flange;

the abutment joints extend in a first direction and are defined at engagements of respective pairs of the rim flanges the water passages are defined by laterally extending channels at the rims of the metal cups that extend through the abutment joints in a second direction perpendicularly with respect to the first direction, the water passages recessed into the rim flanges and permitting intercommunication of the cup volumes of the metal cups through the abutment joints between respective ones of the first and second sets of end cups and the at least one set of intermediate cups when assembled together in the thermoplastic frame.

3. The ice-tray of claim 2 wherein the laterally extending channels extend in at least two perpendicular directions from each cup volume.

4. The ice-tray of claim 3 wherein:

the water passages of each of the first and second sets of end cups are defined by only two laterally extending channels from each cup volume; and the water passages of the at least one set of intermediate cups are defined by at least three laterally extending channels extending from each cup volume; whereby an implementation of a number of respective ones of the end cups and the intermediate cups can be assembled into the ice-tray having two rows of metal cups and an arbitrary number of columns of metal cups.

5. The ice-tray of claim 1 wherein an outwardly facing one of the rim flanges is adapted to abut a corresponding planar wall on the first side of the thermoplastic frame, the abutting between the rim flange and the planar wall aligning the cups with respect to the planar wall.

6. The ice-tray of claim 1 wherein each set of cups provides two cup volumes that define the corresponding ice cubes.

7. The ice-tray of claim 1 wherein the thermoplastic frame mechanically captures the metal cups between thermoplastic elements formed around the metal cups, and wherein:

the thermoplastic elements include frame walls that define upper surfaces and extend about frame pockets that receive respective ones of the multiple sets of cups;

the abutment joints vertically align with and are supported by the upper surfaces of the respective frame walls.

8. The ice-tray of claim 1 further including a sensor communicating with at least one fabricated metal cup for detecting a state of water within the fabricated metal cup as being frozen or unfrozen.

9. The ice-tray of claim 8 wherein the sensor is an electrode pair communicating with a circuit sensing a change in electrical properties between the electrode pair caused by a freezing of water.

10. The ice-tray of claim 1 further including a heater communicating with the fabricated metal cups for heating the fabricated metal cups to release the ice cubes formed in the fabricated metal cups.

11. The ice-tray of claim 10 wherein the heater is an induction heater communicating with the fabricated metal cups through a magnetic field inducing eddy currents in the metal of the fabricated metal cups.

12. The ice-tray of claim 1 wherein the thermoplastic frame includes an attachment for engaging with the ice machine to permit rotation of the thermoplastic frame about an axis perpendicular to the common direction.

13. The ice-tray of claim 1 wherein the fabricated metal cups have walls that slope inward away from the rim to permit a discharge of frozen ice cubes therefrom.

14. The ice-tray of claim 1 wherein the fabricated metal cups are fabricated from a metal selected from the group consisting of stainless steel and aluminum.

15. An ice-tray for use in an ice-making machine, the ice-tray comprising:

a modular cup arrangement providing multiple sets of cups, including:

a first set of end cups and a second set of end cups respectively provided at first and second ends of the modular cup arrangement toward first and second ends of the ice-tray;

at least one set of intermediate cups arranged between the first and second sets of end cups;

wherein:

each of the first and second sets of end cups and the at least one set of intermediate cups includes:

a set of metal cups each having a rim that defines an opening of the respective metal cup for receiving water into at least one cup volume bounded by interconnected cup sidewalls extending downwardly from the rim and a cup bottom wall displaced downwardly from the rim with the cup sidewalls and cup bottom wall collectively defining a shape of an ice cube that may be frozen within the at least one cup volume; and a thermoplastic frame in which the modular cup arrangement is fixedly mounted by capturing the outer periphery of the modular cup arrangement to produce an integrated ice-tray of dissimilar materials; wherein:

the metal cups of the first and second sets of end cups and the at least one set of intermediate cups fixedly captured by the thermoplastic frame providing an integrated structure of the ice-tray in which the openings of the metal cups face a common direction to receive water from the ice-making machine supporting the ice tray therein;

adjacent ones of the first and second sets of end cups and the at least one set of intermediate cups define abutment joints providing water passages to equalize a volume of water received from the ice-making machine into equalized volumes of water in the metal cups of the first and second sets of end cups and the at least one set of intermediate cups a sensor communicating with at least one fabricated metal cup for detecting a state of water within the fabricated metal cup as being frozen or unfrozen wherein:

the sensor is an electrode pair communicating with a circuit sensing a change in electrical properties between the electrode pair caused by a freezing of water; and the at least one fabricated metal cup defines a multi-segmented cup, including:

a first metal bisected cup portion of the respective fabricated metal cup;

a second metal bisected cup portion of the respective fabricated metal cup;

a divider made from an electrically insulating material and arranged between the first and second metal bisected cup portions, the divider connected to the first metal bisected cup portion at a first side of the divider and connected to the second metal bisected cup portion at a second side of the divider providing two electrically isolated halves of the multi-segmented cup defining the at least one fabricated metal cup with the first and second metal bisected cup portions and the intermediate divider joined to each other to collectively provide a watertight structure of the multi-segmented cup; and the electrode pair of the sensor including:

a first electrode electrically connected to the first metal bisected cup portion; and a second electrode electrically connected to the second metal bisected cup portion.

16. The ice-tray of claim 15 wherein the circuit analyzes at least one of a value of resistance and capacitance between the sensor electrodes to compare that value against a threshold indicating frozen water and unfrozen water.

17. The ice-tray of claim 16 wherein the circuit further analyzes the value to detect an empty tray.

18. A method of fabricating an ice-tray including:(a) a set of end cups having a first configuration; (b) a set of intermediate cups having a second configuration, wherein each of the sets of end and intermediate cups includes metal cups, with each of the metal cups having an opening at a rim for receiving water into a cup volume during a water filling procedure, the cup volume defining a shape of an ice cube that may be frozen within the fabricated metal cups; and (c) a thermoplastic frame adapted to receive and retain the set of end cups and the set of intermediate cups with respect to each other with the openings of the metal cups facing in a common direction to receive water from an ice-making machine supporting the ice tray therein, the method comprising:

(a) inserting the set of end cups and the set of intermediate cups into the thermoplastic frame; and (b) affixing the set of end cups and the set of intermediate cups to the thermoplastic frame by engaging retainers so that:

the metal cups and the thermoplastic frame are fixed to each other to provide an integrated structure of dissimilar materials; and water passages extend across joints defined between the set of end cups and the set of intermediate cups to equalize volumes of water in the metal cups during the water filling procedure.

19. A modular ice-tray system providing ice-trays with different configurations for use in different ice-making machines, the modular ice-tray system comprising:

multiple sets of metal cups;

a first ice-tray configured for use with a first ice-making machine, the first ice-tray having:

a first thermoplastic frame that includes a first retainer; and a first modular cup arrangement mounted in the first thermoplastic frame with the first retainer engaging an upper surface of the first modular cup arrangement and vertically fixing and preventing vertical removal of the first modular cup arrangement upwardly out of the first thermoplastic frame to produce a first integrated structure, the first modular cup arrangement having a first number of sets of the metal cups for making a corresponding first number of ice cubes within the first ice-tray;

a second ice-tray configured for use with a second ice-making machine, the second ice tray having:

a second thermoplastic frame that include a second retainer; and a second modular cup arrangement mounted in the second thermoplastic frame with the second retainer engaging an upper surface the second modular cup arrangement and vertically fixing and preventing vertical removal of the second modular cup arrangement upwardly out of the second thermoplastic frame to produce a second integrated structure, the second modular cup arrangement having a second number of sets of the metal cups for making a corresponding second number of ice cubes within the second ice-tray.

20. A modular ice-tray comprising:

a modular cup arrangement having at least a first set of cups and a second set of cups, with each of the first and second sets of cups:

being made from a metal material and having a rim that defines:

an outer perimeter edge and an upper surface with the outer perimeter edges of the first and second sets of cups abutting each other to define:

an abutment joint at an engagement interface between the first and second sets of cups; and a modular cup arrangement outer perimeter defining a collective outer perimeter of the abutting first and second sets of cups;

a thermoplastic frame in which the modular cup arrangement is integrated, the thermoplastic frame including:

a frame outer perimeter that engages an upper surface of the modular cup arrangement outer perimeter to vertically capture the modular cup arrangement.

21. The modular ice-tray of claim 20, wherein the thermoplastic frame further comprises:

a cross member that extends transversely across the thermoplastic frame and engages a lower surface of each rim at the abutment joint; and a retainer that engages an upper surface of each rim at the abutment joint so that the rims are sandwiched between the cross member and the retainer.

22. The modular ice-tray of claim 21, wherein the retainer is defined by a thermoplastic boss that is staked downwardly against the upper surfaces of the rims at the abutment joint.

* * * * *